US008136196B2

(12) United States Patent
Dingert

(10) Patent No.: US 8,136,196 B2
(45) Date of Patent: Mar. 20, 2012

(54) DUSTING TOOL

(75) Inventor: Uwe Dingert, Abtsteinach (DE)

(73) Assignee: Carl Freudenberg KG, Weinheim (DE)

( * ) Notice: Subject to any disclaimer, the term of this patent is extended or adjusted under 35 U.S.C. 154(b) by 948 days.

(21) Appl. No.: 12/103,485

(22) Filed: Apr. 15, 2008

(65) Prior Publication Data

US 2008/0250589 A1 Oct. 16, 2008

(30) Foreign Application Priority Data

Apr. 16, 2007 (DE) ..... 10 2007 018 214

(51) Int. Cl.
*A46B 5/02* (2006.01)

(52) U.S. Cl. ..... 15/144.3; 15/143.1; 15/209.1; 15/172

(58) Field of Classification Search ..... 15/144.3, 15/143.1, 209.1, 210.1, 172
See application file for complete search history.

(56) References Cited

U.S. PATENT DOCUMENTS

| | | | | |
|---|---|---|---|---|
| 1,713,815 | A | 5/1929 | Berthelote | |
| 6,230,356 | B1 * | 5/2001 | Hyo-Moon | 15/167.1 |
| 6,357,073 | B1 * | 3/2002 | Yue | 15/167.1 |
| 7,032,270 | B2 * | 4/2006 | Vitantonio et al. | 15/104.94 |
| 7,526,828 | B2 * | 5/2009 | Kniese | 15/167.1 |
| 2002/0148061 | A1 | 10/2002 | Tanaka et al. | |
| 2008/0148507 | A1 | 6/2008 | Kniese | |

FOREIGN PATENT DOCUMENTS

| | | | |
|---|---|---|---|
| CA | 2598296 | A1 | 8/2006 |
| DE | 8910609 | U1 | 12/1989 |
| DE | 202004004793 | U1 | 5/2004 |
| DE | 102005008199 | A1 | 8/2006 |

* cited by examiner

*Primary Examiner* — Shay Karls
(74) *Attorney, Agent, or Firm* — Leydig, Voit & Mayer, Ltd.

(57) ABSTRACT

A dusting tool (1) with a handle (2) to which two bars (3, 4) are attached at a certain distance from each other, with the free ends (5, 6) of said bars (3, 4) being connected to each other and with a number of spacers (7) being disposed between said bars (3, 4).

9 Claims, 3 Drawing Sheets

DUSTING TOOL

FIELD OF THE INVENTION

The subject matter of the present invention relates to a dusting tool with a handle to which two bars are attached at a certain distance from each other.

BACKGROUND OF THE INVENTION

The subject matter of the present invention relates to a dusting tool with a handle to which two bars are attached at a certain distance from each other.

Dusting tools of this type are known from DE 20 2004 004 793 U1. On the bars of dusting tools of this type, cleaning cloths having a plurality of fiber sections are mounted. For cleaning, the dusting tool is moved across the surfaces to be cleaned, and the dust particles are trapped in the fiber sections. The bars of dusting tools of this type have a rigid design, which makes it difficult to clean curved surfaces. In addition, dusting tools are known, to the handle of which a pole is attached, which makes it possible to reach higher-lying surfaces as well. However, these dusting tools are again suitable only for cleaning even surfaces since the section of the dusting tool which holds the cleaning fibers has a rigid design and therefore is unable to conform to curved surfaces. Furthermore, the edge areas of high-lying surfaces can only be reached with difficulty.

SUMMARY OF THE INVENTION

The problem to be solved by the present invention is to make available a dusting tool which can be used to clean the entire surface of objects having an uneven surface.

To solve this problem the free ends of the bars are connected to each other, and between the bars, a number of spacers are disposed.

According to the present invention, the two bars are designed to be elastic, and the spacers are designed to be pressure- and/or tension-resistant so as to be able to transfer forces from one of the bars to the respective other bar. A first bar is elastically deformed as soon as it touches an uneven surface or as soon as it is elastically deflected in any other manner, and the deflection of the first bar is transferred to a second bar because the bars are connected to each other by means of the spacers. Both bars act as pressure and elastic bending bars. As a force is exerted on the first bar, said bar exerts a tensile force on the end of the second bar, which force tensions the first bar and deflects it in a bow-shaped manner. The second bar exerts a counterforce to the tensile force, as a result of which the second bar is subjected to a compressive bending strain. The spacers prevent the middle portion of the second bar from moving away from the first bar a distance greater than predetermined by the length of the spacer so that the middle portion of the second bar cannot be deflected outwardly. This ensures a bowlike curvature of the bars and thus a superior cleaning efficiency on uneven or hard-to-reach or high-lying surfaces.

The spacers can be attached to the bars by means of hinged supports. This improves both the transfer of forces from the inner to the outer leg as well as the mobility of the wringing device.

The hinged connection of the spacers can be implemented by means of film hinges. Film hinges have a simple design and can therefore be easily manufactured. Furthermore, film hinges have only one degree of freedom, thus ensuring a high stability of the dusting tool as well as high flexibility.

The bars and the spacers can be made of the same material and can be integrally formed in one piece. Dusting tools of this type can be produced easily and inexpensively. In addition, the dusting tool is preferably made of a plastic injection-molded part which allows easy and inexpensive production of large quantities.

The handle may comprise an actuating device by means of which at least one of the two bars can be shortened or lengthened. To this end, the actuating device can comprise a push button which is connected to a mechanism in such a manner that by actuating the push button, a bar is lengthened or shortened. By lengthening or shortening a bar, the bars can be curved in a predefined manner so as to make cleaning easier and to allow uneven surfaces to be cleaned more effectively.

The actuating device can be designed so that one bar can be lengthened and the other bar shortened at the same time. By lengthening and shortening the bars at the same time, the curving effect of the bars is enhanced, and the cleaning efficiency is further improved.

It is possible for a pole to be attached to the handle. With such a pole, the higher-lying surfaces can be reached more readily. The pole can be designed so that the actuating device can also be actuated at the end of the handle of the pole.

It is possible to mount a cleaning cloth on the bars. The cleaning cloth can be a cloth for multiple uses or a disposable cloth. The cleaning cloth is preferably made of a nonwoven fabric which is readily and inexpensively available.

At least one of the bars can have an active cleaning surface. To this end, a fiber layer can be attached to one surface of the bar or to both surfaces, from which fiber layer the dirt adhering to it can be easily removed after the cleaning operation.

The bars can be designed so as to have a flat surface. This improves the cleaning efficiency of the dusting tool.

BRIEF DESCRIPTION OF THE SEVERAL VIEWS OF THE DRAWINGS

A few practical examples of the dusting tool according to the present invention will be explained in greater detail below with reference to the figures. As can be seen.

DETAILED DESCRIPTION OF THE PREFERRED EMBODIMENTS

Figure 1:
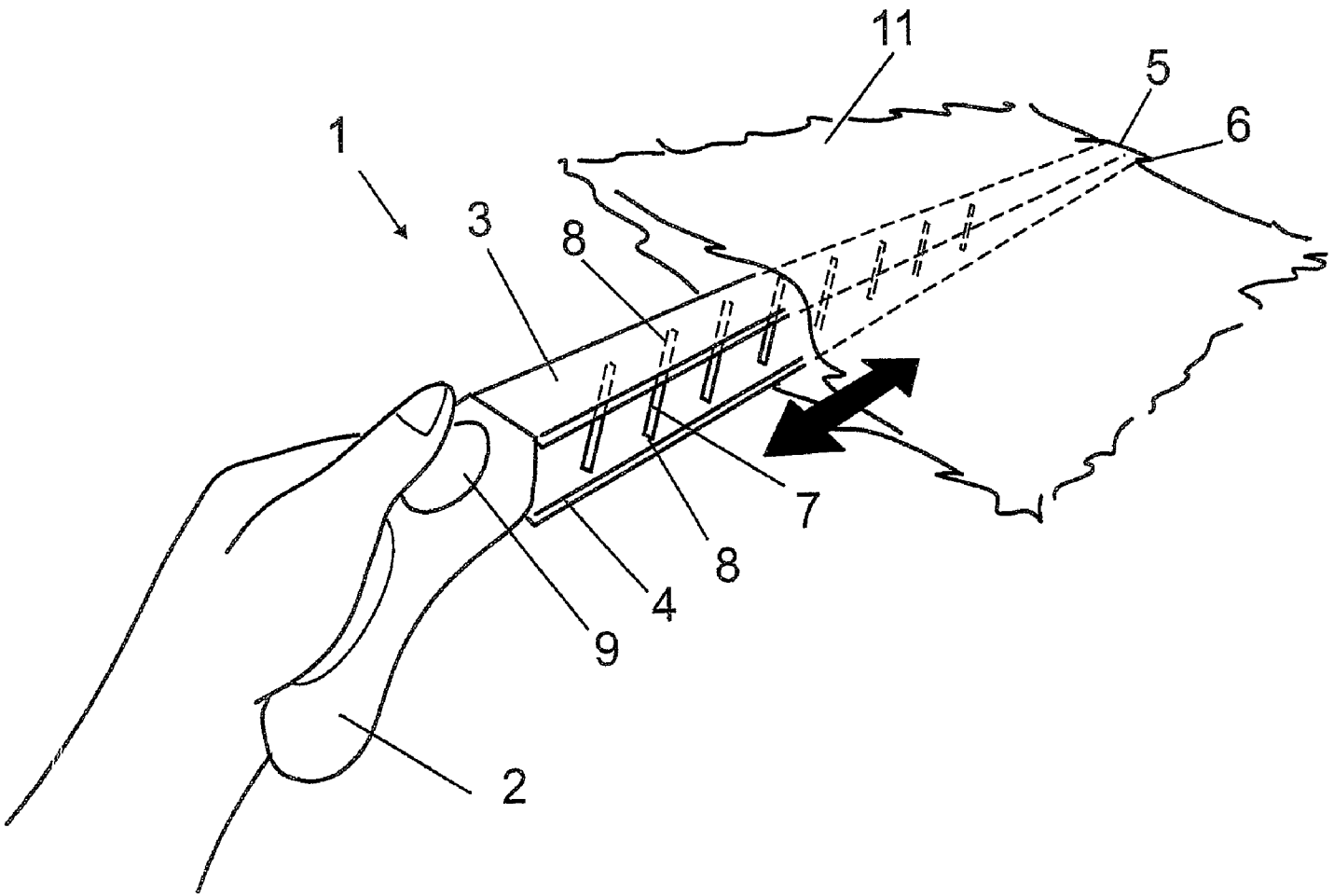
FIG. 1 shows a diagrammatic representation of a dusting tool according to the present invention.

FIG. 1 shows a dusting tool 1 for dry dusting the surfaces of objects. The dusting tool 1 comprises a handle 2 to which two bars 3, 4 are attached at a certain distance from each other. The free ends 5, 6 of the bars 3, 4 are connected to each other. Between the bars 3, 4, a number of spacers 7 are disposed, which spacers are connected to the bars 3, 4 by means of hinged supports in the form of film hinges 8. The bars 3, 4 and the spacers 7 are made of a plastic material, in this case of polypropylene, and both are made of the same material and are integrally formed in one piece. They are manufactured by means of the injection molding method. Disposed to handle 2 is an actuating device 9. In this particular embodiment, the actuating device 9 comprises a push button which can be actuated by the thumb of a user. By actuating the push button of the actuating device 9, the first bar 3 is lengthened and the second bar 4 is shortened at the same time, which causes the dusting tool 1 to be bent to a predetermined curvature. A cleaning cloth 11, which is made of a multilayer nonwoven material and which can comprise fringed strands for more effective cleaning, is mounted on the bars 3, 4.

Figure 2:
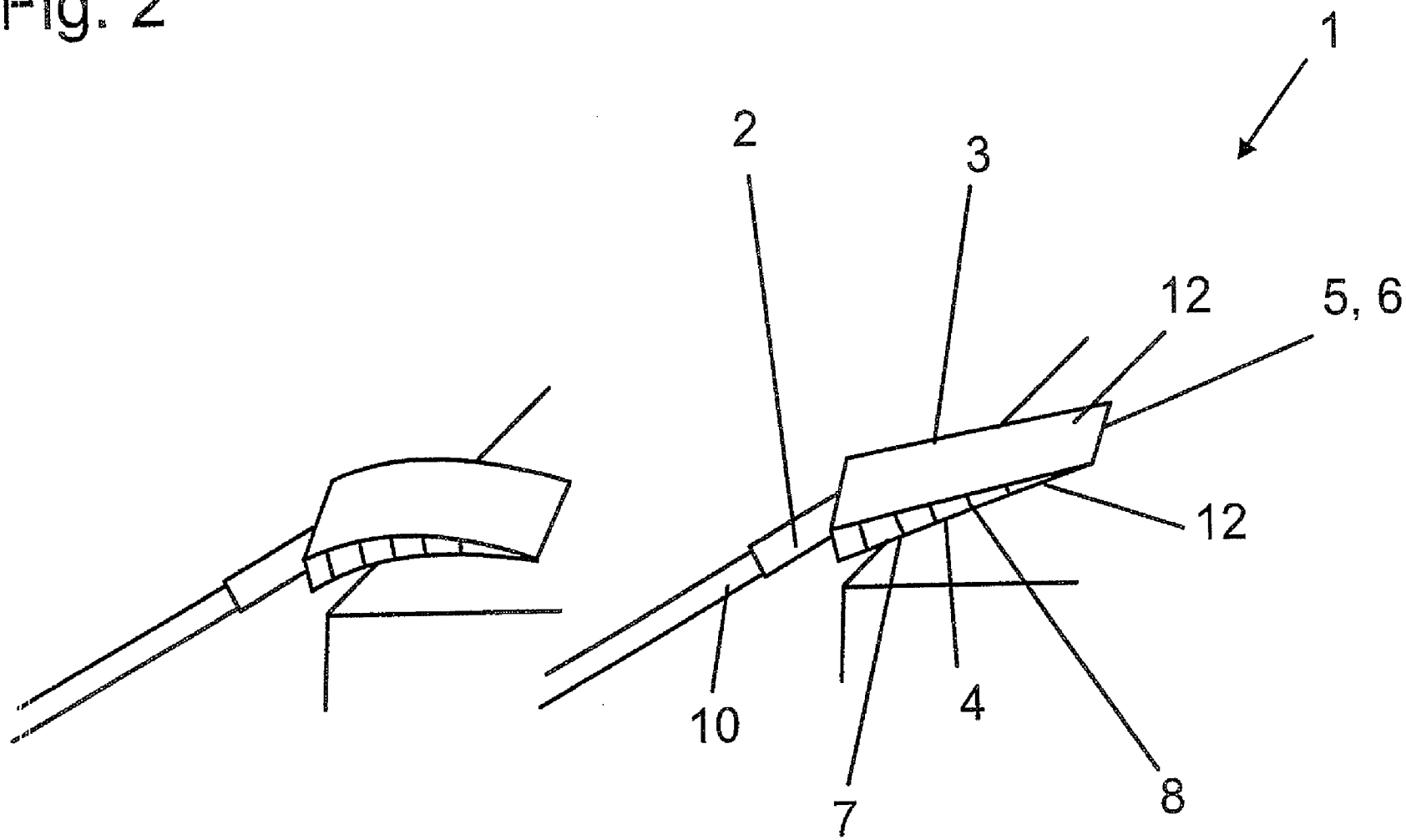
FIG. 2 shows a diagrammatic representation of a dusting tool with a pole and bars having an active cleaning surface.

FIG. 2 shows a dusting tool according to FIG. 1, except that in this embodiment, a pole 10 is attached to the handle 2. The pole also comprises an actuating device which is connected to the actuating device 9 of handle 2. The bars 3, 4 are designed so as to have a flat surface and comprise an active cleaning surface 12. To this end, fibers that have an active cleaning effect are glued to the surfaces of the bars 3, 4.

Figure 3:
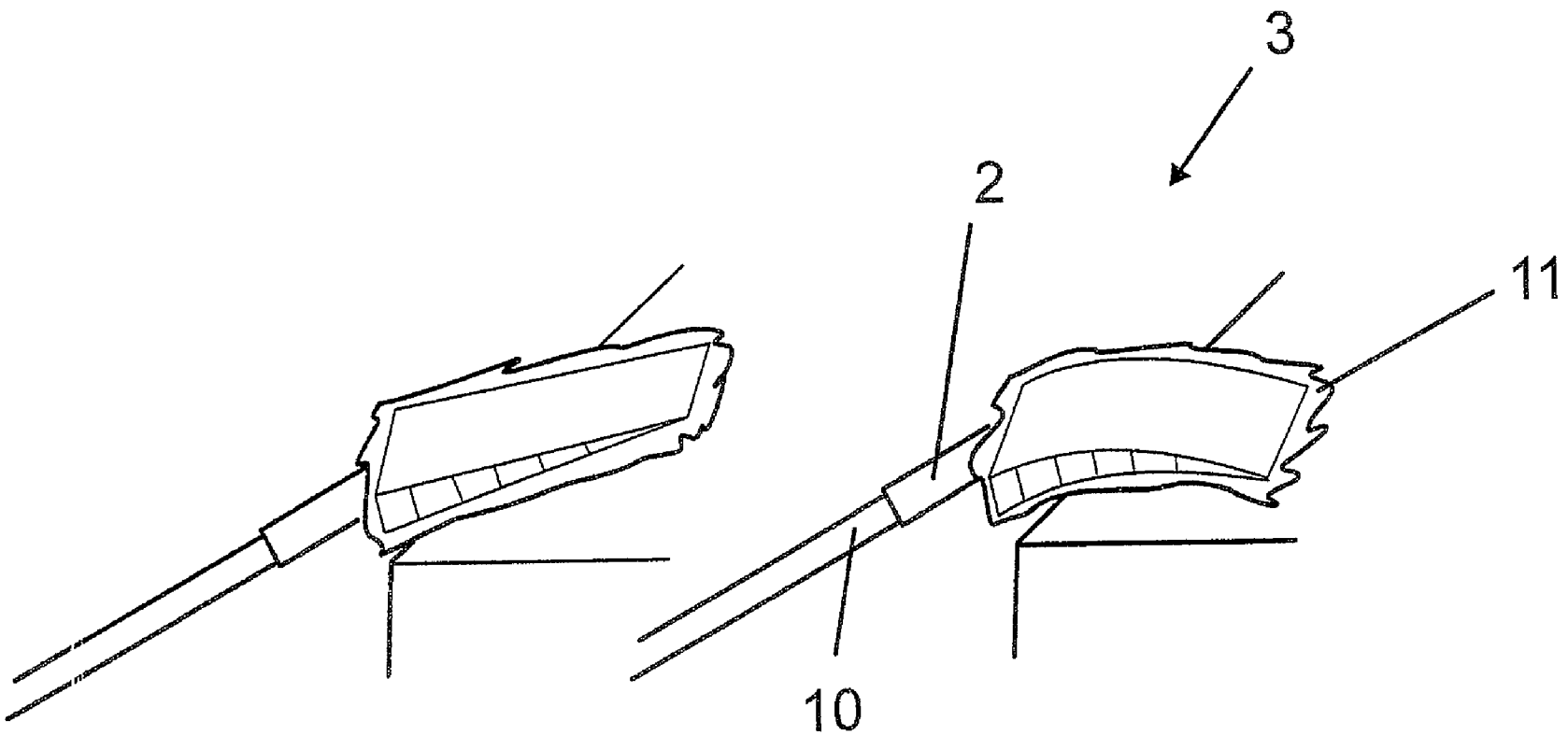
FIG. 3 shows a diagrammatic representation of a dusting tool with a pole and a mounted cleaning cloth.

FIG. 3 shows a dusting tool according to FIG. 2, except that in this embodiment, a cleaning cloth 11 is mounted on the bars 3, 4.

The invention claimed is:

1. A dusting tool comprising a handle to which two bars are attached spaced a certain distance from each other, the bars having free ends that are connected to each other with a plurality of spacers being disposed between the bars and an actuating device that is disposed on the handle for lengthening or shortening at least one of the two bars and thereby causing the dusting tool to be bent to a predetermined curvature.

2. The dusting tool as in claim 1, wherein the spacers are attached to the bars by hinged supports.

3. The dusting tool as in claim 2, wherein the hinged supports of the spacers comprise film hinges.

4. The dusting tool as in claim 1, wherein the bars and the spacers are made of the same material and are integrally farmed in one piece.

5. The dusting tool as in claim 1, wherein the actuating device is configured such that so that one bar can be lengthened and the other bar can be shortened at the same time.

6. The dusting tool as in claim 1, wherein a pole is attachable to the handle.

7. The dusting tool as in claim 1, wherein a cleaning cloth is mountable on the bars.

8. The dusting tool as in claim 1, wherein at least one of the bars comprises an active cleaning surface.

9. The dusting tool as in claim 1, wherein the bars are configured so as to have a flat surface.

* * * * *